US009340340B2

(12) United States Patent
Beckman

(10) Patent No.: US 9,340,340 B2
(45) Date of Patent: May 17, 2016

(54) SELECTABLE-LENGTH ZIP TIE AND TAPE

(71) Applicant: Christopher V. Beckman, San Diego, CA (US)

(72) Inventor: Christopher V. Beckman, San Diego, CA (US)

( * ) Notice: Subject to any disclaimer, the term of this patent is extended or adjusted under 35 U.S.C. 154(b) by 0 days.

(21) Appl. No.: 14/217,414

(22) Filed: Mar. 17, 2014

(65) Prior Publication Data

US 2014/0283340 A1 Sep. 25, 2014

Related U.S. Application Data

(60) Provisional application No. 61/852,120, filed on Mar. 15, 2013.

(51) Int. Cl.
*B65D 63/10* (2006.01)

(52) U.S. Cl.
CPC ..... *B65D 63/109* (2013.01); *B65D 63/1018* (2013.01); *Y10T 24/1498* (2015.01)

(58) Field of Classification Search
CPC ..... B65D 63/109; B65D 63/1018; Y10T 24/1498
See application file for complete search history.

(56) References Cited

U.S. PATENT DOCUMENTS

| | | | | | |
|---|---|---|---|---|---|
| 1,829,613 | A | * | 10/1931 | Sato | 402/15 |
| 2,805,673 | A | * | 9/1957 | Solomon | 132/275 |
| 3,438,095 | A | * | 4/1969 | Evans | 24/16 PB |
| 3,973,610 | A | * | 8/1976 | Ballin | 383/71 |
| 4,045,843 | A | * | 9/1977 | Loose et al. | 24/16 PB |
| 4,150,463 | A | * | 4/1979 | Brown | 24/16 PB |
| 4,377,872 | A | * | 3/1983 | Daniell, Jr. | 2/321 |
| 2005/0251967 | A1 | * | 11/2005 | McNeill | 24/16 PB |
| 2006/0244244 | A1 | * | 11/2006 | Blackburn | 280/728.2 |
| 2008/0276432 | A1 | * | 11/2008 | McNeill | 24/16 PB |
| 2009/0282654 | A1 | * | 11/2009 | Gallant | 24/16 PB |
| 2011/0271491 | A1 | * | 11/2011 | Clawson | 24/16 PB |
| 2012/0210541 | A1 | * | 8/2012 | Koncelik, Jr. | 24/21 |

* cited by examiner

*Primary Examiner* — Robert J Sandy
*Assistant Examiner* — Louis Mercado

(57) ABSTRACT

New fastening devices and techniques are provided. A new self-ratcheting cord is provided, with unlimited possible divisions and insertion points for self-threading and -ratcheting along its length. In some embodiments, the insertion points have ports through which an end of the cord can be threaded. Ridges perpendicular to the length of the cord line the exterior and have an appropriate size, shape and material permitting the cord to move in the direction of insertion through the ports, but limiting reversal. In some embodiments, ridges also line the inside of each port, parallel to the port, and perpendicular to a length of cord at points threaded through the port. In some embodiments, the ports themselves have an exterior shape to lock the cord. Some embodiments also have periodic scoring and other built-in devices to permit snapping the cord by hand at any desired length.

20 Claims, 7 Drawing Sheets

© 2013-2014 Christopher V. Beckman

© 2013-2014 Christopher V. Beckman

© 2013 - 2015 Christopher V. Beckman

© 2013 - 2015 Christopher V. Beckman

© 2013 - 2015 Christopher V. Beckman

© 2013 - 2015 Christopher V. Beckman

© 2013-2014 Christopher V. Beckman

© 2013-2014 Christopher V. Beckman

SELECTABLE-LENGTH ZIP TIE AND TAPE

CROSS-REFERENCE TO RELATED APPLICATION

This application claims the benefit of U.S. Provisional Application No. 61/852,120, filed Mar. 15, 2013, the entire contents of which are hereby incorporated by reference into the present application.

COPYRIGHT NOTICE

© Copyright 2013-2014 Christopher V. Beckman. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to tapes, cords, zip ties and other flexible fasteners.

BACKGROUND OF THE INVENTION

Zip ties and other flexible synthetic cords and adhesive tapes have been used to fasten together loose items for many decades. Most fastening cords hold items together with knots and friction. Zip ties implement a one-way looped ratchet at one end of a length of cord, through which the other end may be inserted and, due to sloped teeth along the length of the cord interfacing with the ratchet, tightened and locked in place. In general, adhesive tapes are flatter along their length than synthetic cords, and often include an adhesive on at least one side. As a result, tape is well-suited for jobs binding flat, smooth items.

It should be understood that the disclosures in this application related to the background of the invention in, but not limited to, this section titled "Background," are to aid readers in comprehending the invention, and do not set forth prior art or other publicly known aspects affecting the application; instead the disclosures in this application related to the background of the invention may comprise details of the inventor's own discoveries, work and work results, including aspects of the present invention. Nothing in the disclosures related to the background of the invention is or should be construed as an admission related to prior art or the work of others prior to the conception or reduction to practice of the present invention.

SUMMARY OF THE INVENTION

New devices and techniques for fastening loose items together are provided. In some aspects of the invention, a new uniform, self-ratcheting cord is provided, with unlimited possible divisions (for example, by cutting the cord at any point along its length), and with unlimited potential insertion points for self-threading and ratcheting along its length. In some embodiments, the points of insertion comprise compressible ports through which a loose end of the cord, and a length of cord following it, can be self-threaded. Complementarily-shaped ridges, pawls and/or other ratcheting aspects, approximately perpendicular to the length of the cord, may line the exterior of the cord, and may be an appropriate size, shape and compressibility to permit the cord to move through the ports when so inserted and threaded, but to lock against and prevent backing out. Preferably, the ports are compressible to a limited degree by the act of self-threading, changing conformation preferably chiefly due to pivoting flexibility along the length of the cord material. This design allows the circumference of a port to be squeezed and pass through another port, when inserted through that other port, while maintaining tight holding or ratcheting. Preferred cord embodiments are composed of a sturdy material with bendability, limited flexibility and, especially, limited compressibility and limited stretchability. Hard plastics with a high tensile strength and some bendability, such as nylon, are preferred.

In some embodiments, ridges or a ratchet device are also comprised in the ports, in a parallel configuration to the length of the cord at such ports, but perpendicular to a length of cord threaded through the ports. In some embodiments, the ports themselves may have an exterior shape to assist in locking the cord when threaded. Some embodiments also comprise periodic scoring and/or other built-in devices to permit snapping the cord by hand at any desired length by sufficient bending, twisting, lever-pulling, or other forms of actuation. In still other embodiments, the cord may be released by a button, lever, or by changing the direction or pressure of the cord relative to the port through which it is threaded, at the point where it is threaded through a port. Differential ridge angles and locations within the ports cause then cause these embodiments of cord to release, such that they may be backed out.

CANONS OF CONSTRUCTION AND DEFINITIONS

Where any term is set forth in a sentence, clause or statement ("statement"), each possible meaning, significance and/or sense of any term used in this application should be read as if separately, conjunctively and/or alternatively set forth in additional statements, as necessary to exhaust the possible meanings of each such term and each such statement.

It should also be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

Unless otherwise stated, all trademarks disclosed in this patent document and other distinctive names, emblems, and designs associated with product or service descriptions, are subject to trademark rights. Specific notices related to copyright also accompany the drawings incorporated in this application; the material subject to this notice, however, is not limited to those drawings.

DETAILED DESCRIPTION OF THE INVENTION

Figure 1:
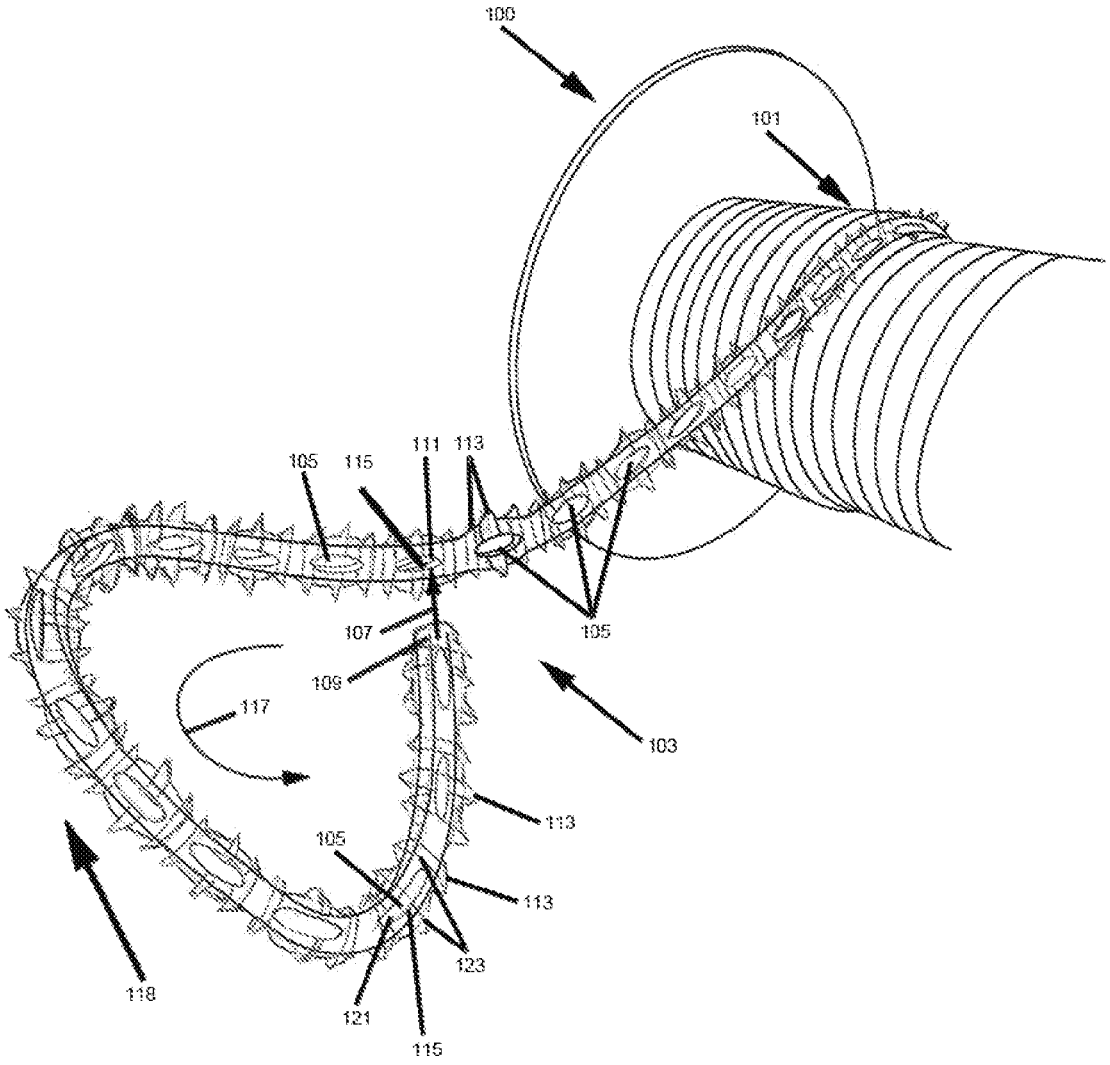
FIG. 1 is a perspective view of a spool of self-ratcheting cord, in accordance with aspects of the present invention, including a paid out length of said cord.

FIG. 1 is a perspective view of a spool 100 of self-ratcheting cord 101, in accordance with aspects of the present invention, including a paid out length 103 of said cord. Cord 101 comprises numerous uniformly distributed ports, such as those examples pictured as 105, along its length, which serve as potential insertion points for threading cord 101 through itself ("self threading), as demonstrated by directional path arrow 107, which shows a threading motion path of the loose end 109 of cord 101, through port 111 (one of ports 105). As will be explained in greater detail below, as cord 101 is threaded through any of ports 105, one-way locking ridges 113, lining the circumference of the roughly cylindrical cord 101, interface with and lock against ridges or a ratchet 115, which line the inside of each port 105. Preferably, one-way locking ridges 113 are sloped on at least some of their sides or profile facing a port during and just prior to insertion for self-threading, permitting the compression of ridges 113 during insertion. However, on the opposite sides of ridges 113, facing in a direction away from a port during and just prior to insertion through it, ridges 113 are either flat or barbed in that direction, preventing cord 101 from backing out of a port 105 once self-threaded through it. In some embodiments, ridges or ratchet 115 comprise complementarily-shaped flat or barbed edges, facing the flat or barbed sides of ridges 113 once ridges 113 have been threaded past ridges or ratchet 115 due to self-threading.

In some such embodiments, ridges or ratchet 115 also comprise sloped surfaces, on at least some of their sides or profile facing the end of the cord 101 just prior to and during self-threading. Because such embodiments require threading in one direction only for proper function, these embodiments may further comprise a camber, natural bend or "memory", causing a tendency of cord 101 to curl in a direction generally toward a proper orientation for self-threading when slack, as shown by curling direction arrow 117, which generally demonstrates the direction of neighboring curl 118 in cord 101. In this way, errors in insertion direction are reduced or eliminated for users of cord 101. In some embodiments, however, in which at least either ridges or ratchets 115 do not comprise the sloped sides or profiles set forth above, cord 101 may be threaded through ports 111 in any direction, and such a camber, natural bend or memory need not be provided in cord 101.

As shown in the figure, ports 111 of cord 101 expand and/or bulge outward from the length of cord, at least during self-threading, in order to accommodate the insertion of an end 109 through a port 111. Preferably, ports 111 maintain at least part of that expansion or bulge prior to insertion, to aid in locating ports 111, and in guiding an end 109 through ports 111. To ease the passage of cord 101 through a port 111 during self-threading, however, ports 111 are compressible, preferably due to the use of a flexible cord material which turns easily along its length. However, to provide a tight fit, and effective ratcheting, the cord material preferably has limited compressibility, or is even not substantially compressible. Furthermore, preferably, when any of ports 111 are compressed during self-threading through another port 111, a central hole or void 121 is substantially eliminated because the combined, compressed material 123 comprising ports 111 comprises a combined, circumference or other perimeter complementary in size and/or shape to, and substantially filling or abutting, a central hole or void 121 of the port 111 through which the cord is being self-threaded.

Figure 2:
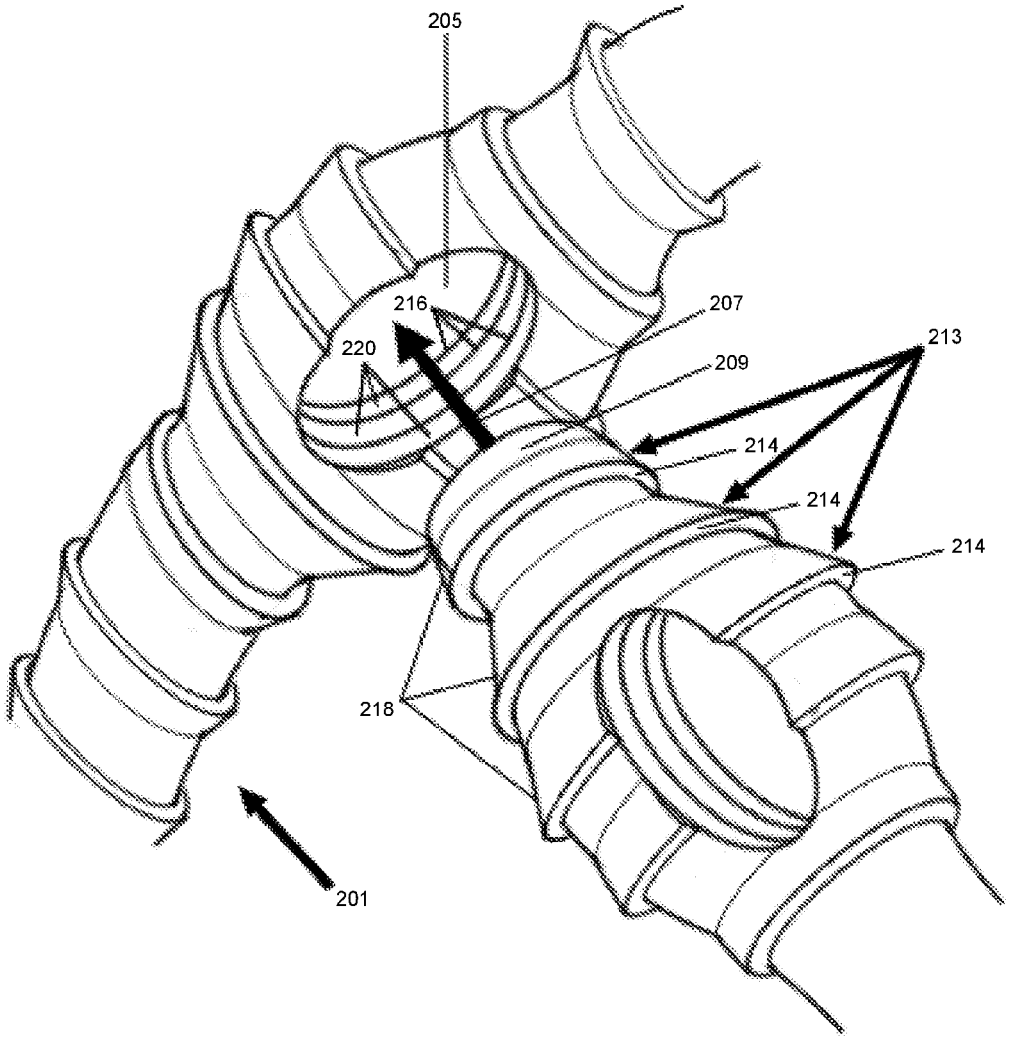
FIG. 2 is a perspective view of parts of the same form of self-ratcheting cord discussed with reference to FIG. 1, above, but larger, to illustrate details of a self-threading and self-ratcheting mechanism of the present invention.

FIG. 2 is a perspective view of parts of the same form of self-ratcheting cord, now 201, discussed with reference to FIG. 1, above, but larger, to illustrate details of a self-threading and self-ratcheting mechanism of the present invention. An end 209 of cord 201 is shown facing an open port 205, similar in nature to ports 105 of FIG. 1. Directional path arrow 207 shows the potential movement of cord end 209 through port 205 when self-threaded through that port. As can be seen more clearly in the present figure, exemplary outer ridges 213 of cord 201 comprise a flat or barbed trailing edge 214, for interlocking with flat edges 216, lining the inside surface of port 205. Flat edges 216 face in the same direction as the direction of threading shown by arrow 207, which direction faces interlocked edges 214 once threaded through port 205. As also shown in greater detail, sloped leading edges 218, facing the direction of port 205 prior to threading end 209 through it, are also comprised in ridges 213, and permit the threading of end 209 through port 205. Similarly, sloped edges 220 also permit and ease threading end 209 through port 205.

Figure 3:
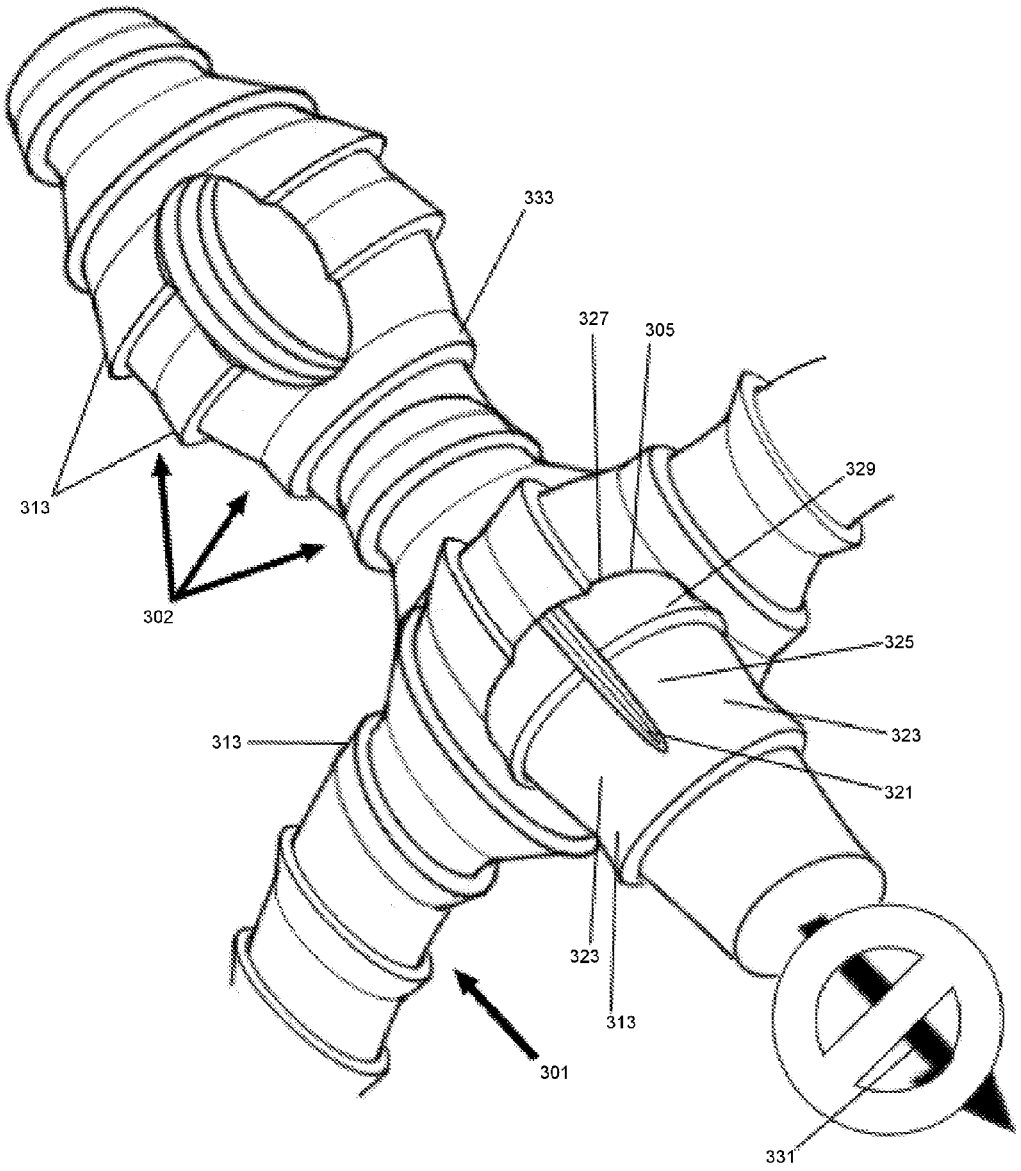
FIG. 3 is a perspective view of the same form of self-ratcheting cord discussed with reference to FIG. 2, above, with part of the cord pulled through one of many self-threading, self-ratcheting ports along the length of the cord.

FIG. 3 is a perspective view of the same form of self-ratcheting cord, now 301, discussed with reference to FIG. 2, above, with part of cord 301, namely, cord section 302, pulled through one of many self-threading, self-ratcheting ports, now shown as 305, along the length of the cord. As discussed above, as one of ports 305, namely 325, is threaded through another port 305, namely 327, port 325 becomes compressed, and its central hole or void 321 is reduced to a slit. The comprised material 323 of port 325 is pressed together, and substantially occupies, with its outer surface ridges, such as the example shown as 329, the entire port 327 through which the material 323 is threaded. In this way, the outer surface ridges of port 325 fully interface with the complementary interior ridges of port 327 as the cord 301 is self-threaded, and cord section 302 is prevented from backing out of port 327 in the direction shown by hypothetical attempted motion arrow 331. Furthermore, as also can be seen in FIG. 3, a subsection 333 of section 302 does not comprise a port 305, yet occupies a substantially identical circumference or space, also complementary to the inner voids of all ports 305, as compressed material 323 of port 325.

As a result, cord 301 may be threaded through any of ports 305, to a wide variety of required degrees of self-threading and ratcheting between the inner ridges or ratchets of ports through which self-threading and ratcheting occurs and the outer ridges of cord 301, such as the examples shown as 313. Threading, ratcheting and locking against backing out is not limited to particular lengths or parts of cord 301, such as parts with or without ports 305. However, as improved in the embodiment discussed immediately below, additional force and features associated with ports 305 may enhance the holding force of cord 301 when self-threaded and fastening together items.

Figure 4:
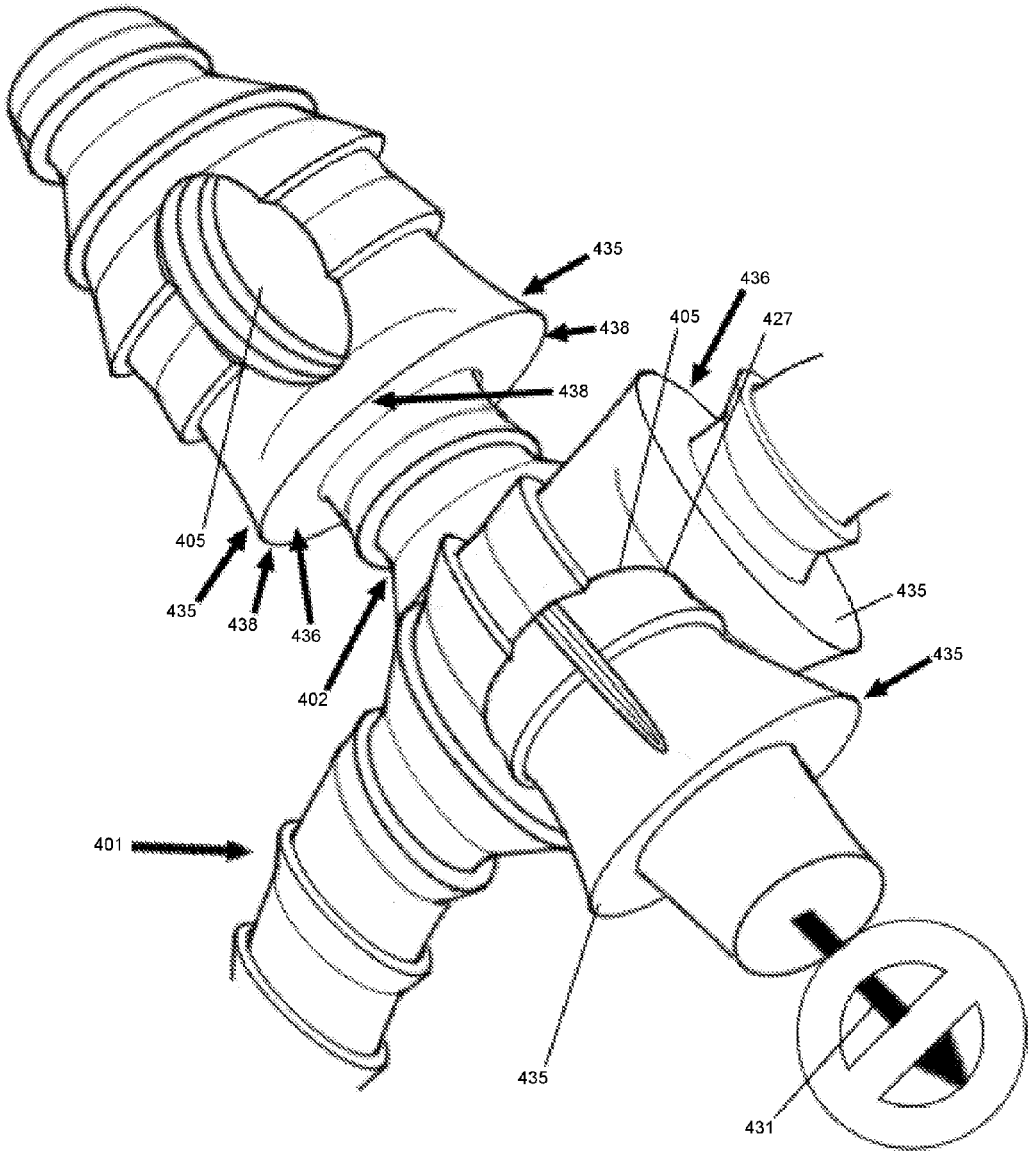
FIG. 4 is a perspective view of an alternative embodiment of a self-ratcheting cord, in accordance with aspects of the present invention, in which exterior features of self-threading ports further comprise additional, larger locking barbs.

FIG. 4 is a perspective view of parts of an alternative embodiment of a self-ratcheting cord, 401, in accordance with aspects of the present invention, in which exterior features of self-threading ports further comprise additional larger locking barbs, such as those examples shown as 435. As shown in the figure, larger locking barbs 435 further enhance the holding power of the self-threading, ratcheting cord 401 by opposing and holding the outer surface of a port 405 through which it has been self-threaded. Preferably, larger locking barb 435 is present on the trailing end of each of ports 405, and, as with several of the locking ridges discussed in embodiments above, comprises a flat surface, in this instance, the examples shown as 436, which face a port through which they have been threaded, and prevent backing out of cord 401 through such a port. For example, larger locking barb 438, which is shown having been threaded through port 427, opposes the attempted movement of cord 401 in the direction shown by arrow 431, preventing cord section 402 from backing out in that direction, by holding the outer surface of port 427 (if pulled against it, in the direction shown by arrow 431) that locking barb 438 faces.

Figure 5:
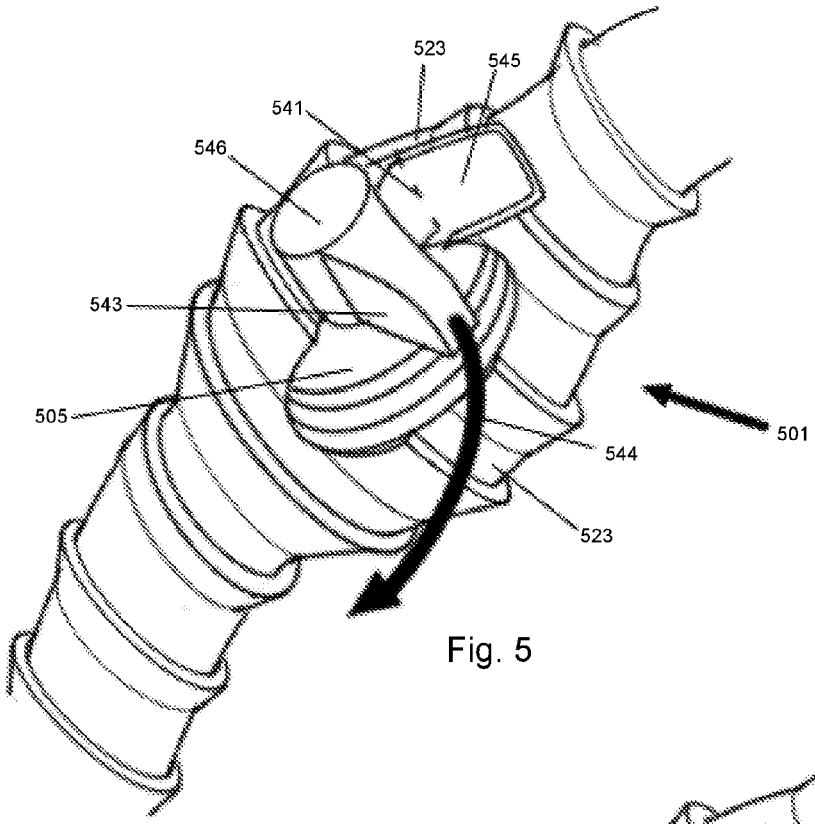
FIG. 5 is a perspective view of another alternative embodiment of a self-ratcheting cord, in accordance with aspects of the present invention, comprising scoring for snapping open lengths of the cord without tools.

FIG. 5 is a perspective view of another alternative embodiment of a self-ratcheting cord 501, in accordance with aspects of the present invention, comprising scoring 541 for snapping open lengths of the cord by hand, without the need for tools. To assist in such selective snapping, a lever 543 rooted in one of two sections of load-bearing connecting material 523, is embedded in a body pocket 545. Due to the body pocket 545, lever 543 does not substantially extend outward beyond the remaining outline or profile of surrounding material of cord 501, unless and until lever 543 is actuated. When a user pulls lever 543 outward, as shown by lever action arrow 544, connecting material 523 is pulled taught across a tensioning stanchion 546. As a result, if lever 543 is sufficiently pulled along the path shown by arrow 544, the connecting material 523 will break completely into two separate pieces, and will no longer hold port 505 closed. If a section of cord 501 is currently held within port 505 when such a lever action breaking connecting material 523 is carried out, that section 502 will then be released, and items held together by cord 501 may no longer be held together.

Due to the size and edges of scoring 541, and the leverage applied by lever 543, the amount of force required to sufficiently pull lever 543 to cause connecting material 523 to break is low enough to be applied by hand by an average person, and far lower than the amount of lengthwise holding force of cord 501 (the holding force resulting from the tensile strength of cord 501).

Figure 6:
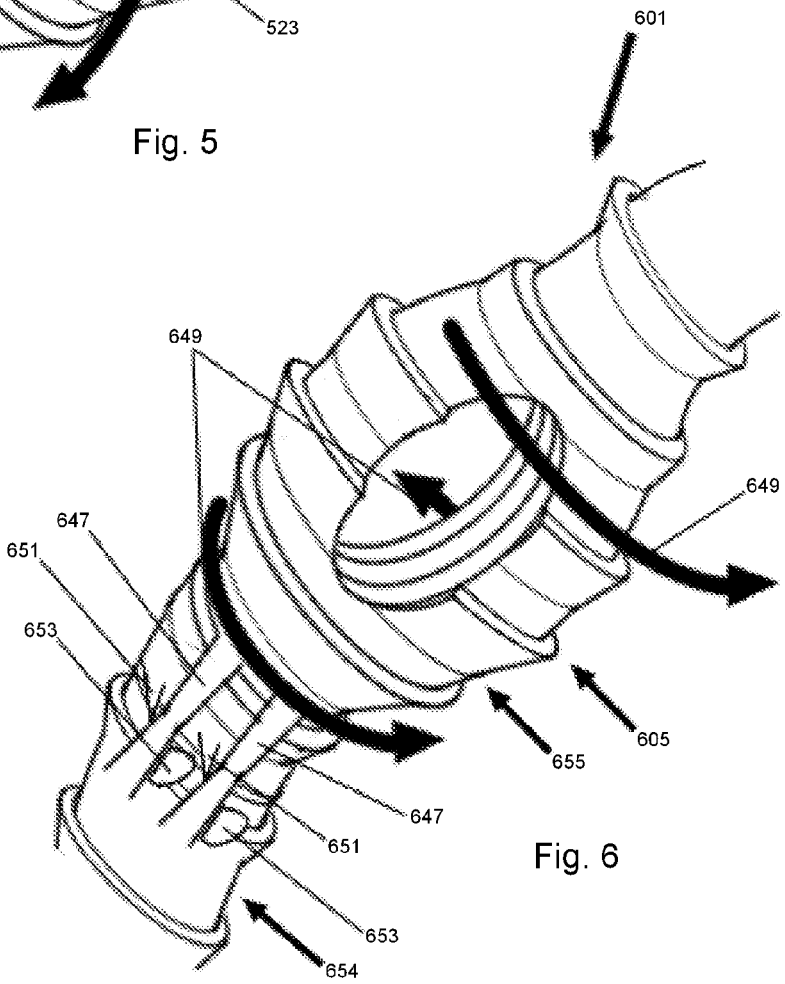
FIG. 6 is a perspective view of another alternative embodiment of a self-ratcheting cord, in accordance with aspects of the present invention, configured for freely selecting and breaking off lengths of the cord by twisting the cord, with no need to use auxiliary tools.

FIG. 6 is a perspective view of another alternative embodiment of a self-ratcheting cord 601, in accordance with aspects of the present invention, configured for freely selecting and breaking off lengths of the cord by twisting the cord, with no need to use auxiliary tools. As mentioned previously, uniformly distributed ports, now 605, preferably bulge slightly when not currently threaded through another port. As one of several added benefits to this design, ports 605 may be used for leverage and grip in twisting part of cord 601 (for example, in the rotational direction indicated by motion arrows 649), which can be used to carry out further aspects of the invention. In one embodiment, load-bearing straps, such as the examples shown as 647, may be completely broken into separate pieces by such twisting. As port 605 is twisted clockwise (in the perspective of the figure), slicing edges 651 are pushed through straps 647, and into cutting blocks 653. As a result, each of straps 647, which otherwise comprise a complete link between two separate parts, 654 and 655, of cord 601, are completely severed, and cord 601 is broken in two at a break point to the left of the port 605 used as a twisting handle.

Figure 7:
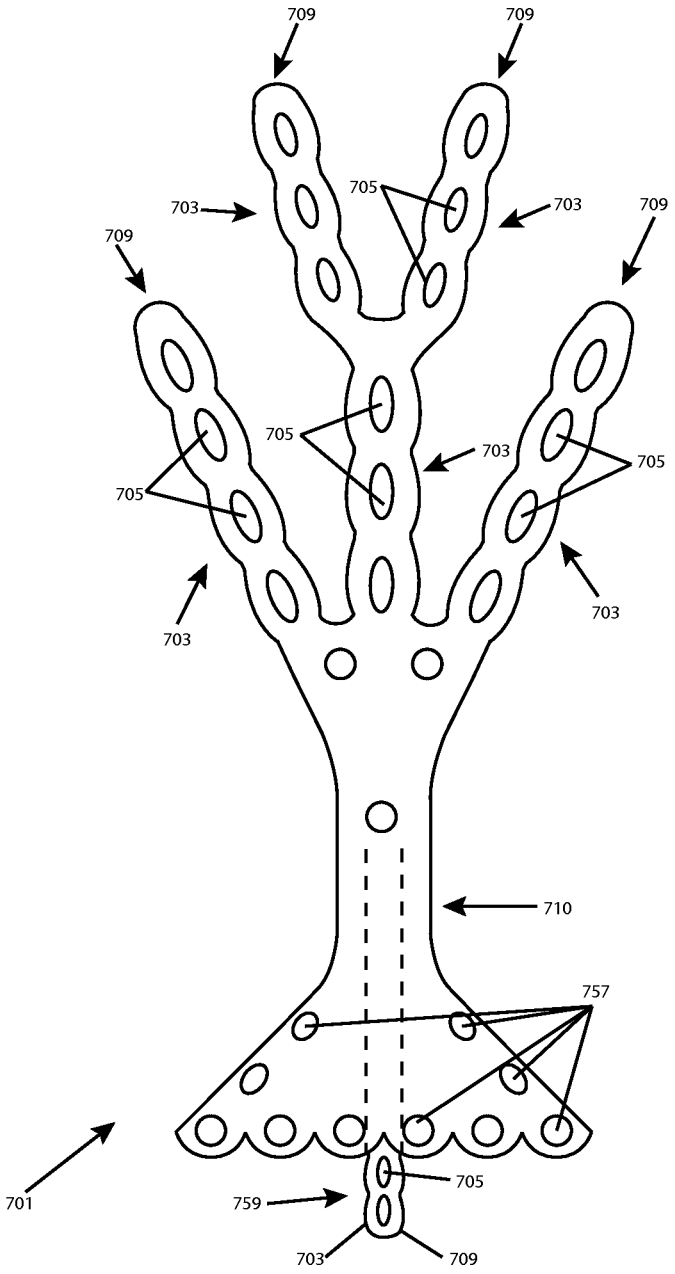
FIG. 7 is a front view of an exemplary ramifying harness comprising self-threading cord, with multiple potential points of insertion, self-threading and ratcheting, in accordance with aspects of the present invention.

FIG. 7 is a front view of an exemplary ramifying harness 701 comprising self-threading cord sections 703, with multiple potential points of insertion, self-threading and ratcheting, in accordance with aspects of the present invention. As in several of the embodiments set forth above, the cord sections comprise uniformly distributed ports, such as the examples now shown as 705, along their length, and further comprise ratchets, barbs or ridges to cause self ratcheting and locking in accordance with aspects of the invention discussed throughout this application. Also as with several of those previously-discussed embodiments, loose ends, now shown as 709, of those cord sections may be threaded through any and several such ports 705, as a user's election, to cause such self-ratcheting and locking. In addition, harness 701 comprises a main body section 710, which may comprise additional, albeit fewer, ports, such as the examples shown as 757, the voids or holes of which are identical in shape and features as the voids or holes of any of the other ports set forth above in this application. By threading the ends 709 of sections 703 through various ports 705 and/or 757, a wide variety of holding configurations for several items, or complex items requiring more than one holding point. In fact, each of ends 709 may be threaded through more than one port 705 and/or 757, creating several more holding loops than would otherwise be possible, at the election of the user. As another potential aspect, a central cord 759 may extend away from the remaining plane of the harness, and therefore may be useful for fastening multiple harnesses together. Of course the number of ends 709, loops and body components, and shapes depicted in FIG. 7 are exemplary only, and a wide variety of complex cord arrangements with multiple ends, sections and body shapes are possible and fall within the scope of the present invention.

Figure 8:
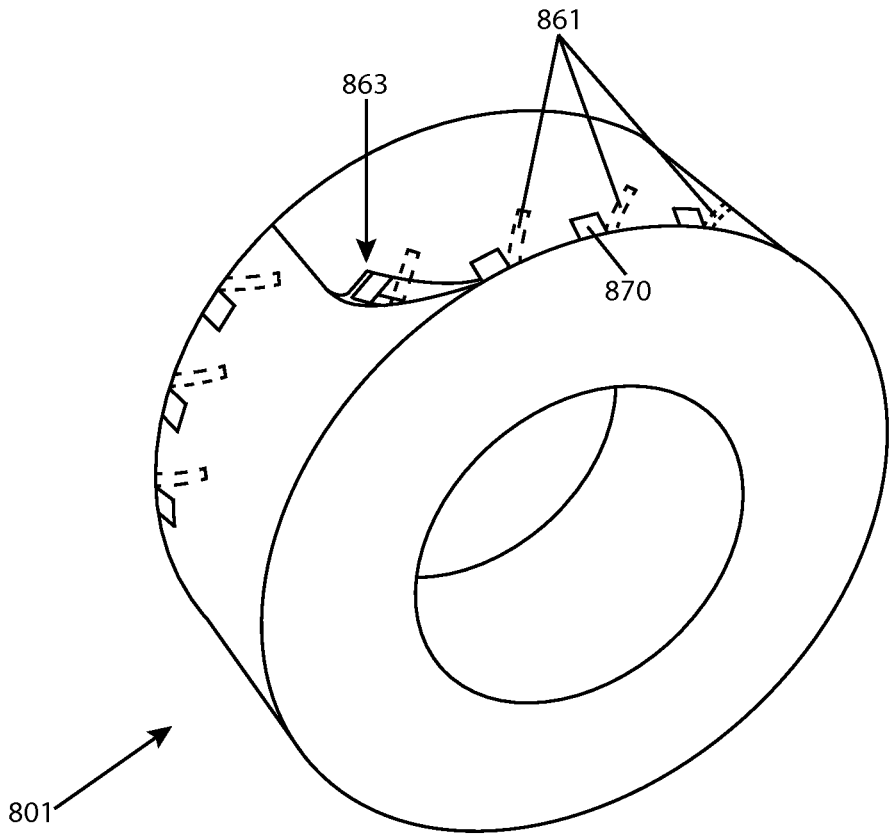
FIG. 8 is a perspective view of a roll of tape or cord 801, in which camber material 861 lifts and exposes a loose end of the tape or cord.

FIG. 8 is a perspective view of a roll of tape or cord 801, in which camber material, such as that shown as elevating strips 861, lifts and exposes a loose end 803 of the tape or cord. Regardless of where tape or cord 801 is cut, producing a loose end such as 803, at least a corner 863 of the tape or cord at the loose end 803 will be raised, rather than laying flat against roll 801. In this way, corner 863 and end 803 may be more easily located, and a user may extract tape or cord from the roll 801. While the roll of tape or cord 801 may include an adhesive, for example, on the side facing roll 801, preferably, the surface of a section 863 of tape or cord abutting each strip 861, in sections 870, contains less adhesive, a weaker adhesive, or has been bound to the roll 801 less completely or effectively (for example, with less force), such that the upward pressure from the camber of elevating strips 861 is able to overcome it. As a result, corner 863 is lifted away from the remainder of roll 801. To enhance the visual impact of corner 863, lighting or coloring may be trained on or caused by corner 863's position, lifted away from roll 801. For example, without contact with roll 801, and its collective color, a translucent tape (and especially, a fluorescent translucent tape) may reveal corner 863 with greater contrast. If camber is used on only one side of roll 801, preferably, the side may be switched periodically along the length of cord or tape, to maintain a flat profile for roll 801.

I claim:

1. A cable device for fastening objects, comprising:

at least one length of cord including a plurality of port portions and a plurality of ports, each port portion comprising at least one of said port(s) positioned along and through said at least one length of cord, at least some of said port portions comprising outer ridges configured to permit passage of said ridges through at least one of said ports in one direction, and to prevent passage of said ridges in a opposite direction to said one direction;

at least one of said port portions comprising a port that is reduced to a slit that is fully closed, when said at least one of said port portions is threaded through another of said port portions, with said at least one of said port portions substantially abutting between said another of said port portions; and said at least one length of cord being of a material with limited compressibility and stretchability, permitting said at least one of said port portions to push against and lock said at least one of said port portions in said opposite direction to said one direction with another of said ports.

2. The cable device for fastening objects of claim 1, wherein said port portions comprise at least one ridge, pawl or other device configured to aid in ratcheting.

3. The cable device for fastening objects of claim 2, wherein said at least one ridge, pawl or other device configured to aid in ratcheting is present on or about at least part of an inward-facing surface of said port portions.

4. The cable device for fastening objects of claim 2, wherein said at least one ridge, pawl or other device configured to aid in ratcheting lines at least one part of an inward-facing surface of said port portions.

5. The cable device for fastening objects of claim 1, wherein said port portions comprise at least one barb, in addition to and differing in shape from said ridges, configured to prevent or resist said length of cord backing out of any of said ports, once threaded through said any of said ports.

6. The cable device for fastening objects of claim 1, wherein said port portions comprise a sloped overall profile configured to permit passing in one direction through said ports, and to prevent passing in another, opposite direction.

7. The cable device for fastening objects of claim 6, wherein said cable device comprises a bent shape, bias or camber configured to cause said cable device to curl in a direction initiating self-threading of said cord.

8. The cable device for fastening objects of claim 7, wherein said bent shape, bias or camber is configured to cause a loose end of said cable device to lift away from a spool on which said cable device is wound.

9. The cable device for fastening objects of claim 8, wherein said cable device is a tape and wherein said bent shape, bias or camber causes a corner of said loose end of said cable device to lift away from a remainder of said loose end and away from said spool on which said cable device is wound.

10. The cable device for fastening objects of claim 9, wherein said corner is configured to manifest a visible color change relative to a remainder of said cable device wound on said spool when lifted away from said remainder of said loose end and lifted away from said spool.

11. The cable device for fastening objects of claim 1, wherein said material is nylon.

12. The cable device for fastening objects of claim 1, wherein said cable device is configured to be broken at any of several desired lengths by hand, by applying a force of less magnitude than a tensile holding force of said cable device, but which force is applied in a different direction than said tensile holding force.

13. The cable device for fastening objects of claim 12, wherein said cable device is configured to be broken at any of several desired lengths by hand by twisting any of said port portions in a rotational direction about said length of cord.

14. The cable device for fastening objects of claim 13, wherein said cable device comprises edges attached to said any of said port portions, said edges being configured to automatically sever connecting material of said length of cord when any of said port portions is twisted.

15. The cable device for fastening objects of claim 1, wherein said outer ridges comprise at least one flat or barbed trailing edge, facing in said opposite direction.

16. The cable device for fastening objects of claim 15, wherein inner ridges line at least one inward-facing surface of said port portions, and wherein said inner ridges comprise at least one edge configured for interlocking with said at least one flat or barbed trailing edge of said outer ridges.

17. A cable device for fastening objects, comprising:

at least one length of cord including a plurality of port portions, each comprising a port positioned along and through said at least one length of cord, a plurality of said port portions comprising outer ridges configured to permit passage of said ridges through at least one of said ports in one direction, and to prevent passage of said ridges in an opposite direction to said one direction;

said at least one length of cord being of a material with limited compressibility and stretchability, which permits bending of said cable device along its length, and which further permits at least one of said port portions to be compressed to eliminate substantially all of a space of one of said ports as said at least one of said port portions passes through another of said ports, and to push against and lock said at least one of said port portions in said opposite direction with said another of said ports;

wherein said outer ridges comprise at least one flat or barbed trailing edge, facing in said opposite direction and wherein inner ridges line at least one inward-facing surface of at least one of said port portions, and wherein said inner ridges comprise at least one edge configured for interlocking with said at least one flat or barbed trailing edge of said outer ridges.

18. The cable device of claim 17, wherein said port portions comprise a sloped overall profile configured to permit passing in one direction through said ports, and to prevent passing in another, opposite direction.

19. The cable device for fastening objects of claim 17, wherein said cable device comprises a bent shape, bias or camber configured to cause said cable device to curl in a direction initiating self-threading through at least one of said ports.

20. The cable device for fastening objects of claim 17, wherein said cable device is a tape and wherein a bent shape, bias or camber causes a corner of a loose end of said cable device to lift away from a remainder of said loose end and away from a spool on which said cable device is wound; and wherein said corner is configured to manifest a visible color change relative to a remainder of said cable device wound on said spool when lifted away from said remainder of said loose end and lifted away from said spool.

* * * * *